US005366183A

United States Patent [19]

Gill

[11] Patent Number: 5,366,183

[45] Date of Patent: Nov. 22, 1994

[54] RAILWAY SIGNALLING SYSTEM

[75] Inventor: David C. Gill, Chippenham, United Kingdom

[73] Assignee: Westinghouse Brake and Signal Holdings Limited, Pew Hill, United Kingdom

[21] Appl. No.: 12,007

[22] Filed: Feb. 1, 1993

[30] Foreign Application Priority Data

Feb. 11, 1992 [GB] United Kingdom ..... 9202829

[51] Int. Cl.[5] ..... B61L 23/14

[52] U.S. Cl. ..... 246/28 R; 246/63 A; 246/187 R

[58] Field of Search ..... 246/27, 28 R, 62, 63 R, 246/63 A, 63 C, 167 R, 182 R, 182 B, 187 R, 187 B, 187 C, 3–5

[56] References Cited

U.S. PATENT DOCUMENTS

| | | | |
|---|---|---|---|
| 3,888,437 | 6/1975 | Birkin | 246/63 R X |
| 4,142,700 | 3/1979 | Ubel | 246/182 B |
| 4,166,599 | 9/1979 | Auer, Jr. et al. | 246/134 X |
| 4,279,395 | 7/1981 | Boggio et al. | 246/187 B X |
| 4,471,929 | 9/1984 | Rhoton et al. | 246/63 R X |
| 4,495,578 | 1/1985 | Sibley et al. | 246/62 X |
| 4,994,969 | 2/1991 | Petit | 246/27 X |

*Primary Examiner*—Michael S. Huppert
*Assistant Examiner*—Scott L. Lowe
*Attorney, Agent, or Firm*—Marshall, O'Toole, Gerstein, Murray & Borun

[57] ABSTRACT

In a railway signalling system, to achieve inter-vehicle headway spacing for railway vehicles (1) travelling on a track (T), there are a) control of vehicles by fixed block signalling and b) control of vehicles by moving block signalling via communication between vehicles. The moving block signalling occurs within a moving block control zone of the track and the fixed block signalling occurs outside that zone, there being the facility of two-way data transmission between vehicles throughout the moving block control zone and the fixed block signalling system not preventing a further vehicle from entering the mowing block control zone when another vehicle is already in that zone and receiving a transmission via the moving block signalling system.

5 Claims, 5 Drawing Sheets

RAILWAY SIGNALLING SYSTEM

FIELD AND BACKGROUND OF THE INVENTION

The present invention relates to a railway signalling system.

It is well known that the headway-critical areas of a metro railway are at stations, turn-arounds and junctions. Here, the minimum permitted-separations between normal-running trains are constrained by station dwell periods, the time required for braking and accelerating, and the time for points to be reset. Conventional fixed-block systems (such as track circuit-based fixed block systems) constrain the separations further because of the time required for trains to clear block boundaries. Fixed block systems also force trains to brake prematurely for track obstacles (stationary trains, junctions with conflicting routes set, etc.). The braking, rather than being a smooth curve, consists of a succession of stepped-down curves.

Metro authorities, facing ever increasing passenger demand, are looking for methods of increasing the maximum train throughput, thereby increasing the offered capacity for the same journey times and dwell periods. A method which fulfills this aim, whilst not incurring considerable cost and effort in modifying existing track circuit layouts, is very desirable. In any case, track circuit technology already works close to its practical limit in terms of achievable headway.

A typical track circuit-based system is illustrated in FIG. 1, which shows plots of speed against distance of a train in relation to a platform 2. The curves in full lines represent typical "service braking" and the curves in broken lines represent typical "emergency braking" profiles. References B1–B5 designate block sections of a track T, and reference numerals 3 designate block section boundaries. Whilst train 1 is stationary at the platform 2, the track circuit codes established in the block sections immediately behind could be as shown. For example, in block section B1, the code is denoted by "80/60". This means that the maximum speed permitted in the block section is 80 km/hr, and the target speed is 60 km/hr. The target speed is the speed for which the driver or an automatic driving system should aim to achieve before leaving the block section. If the train enters block section B2 with a speed greater than 60 km/hr (allowing for equipment tolerances) then the emergency brakes should be applied by a train-borne automatic train protection (ATP) system. The same would be true for block section B2 if the train, having reduced its speed to 60 km/hr, failed to brake to the new target speed of 40 km/hr. (N.B. these speed values are notional values, and are set according to the characteristics of a particular railway). The block section immediately behind the stationary train 1 (or other "obstacle") is coded "0/0". This block section acts as an emergency "overlap" distance. In the worst case, a train braking under emergency conditions would come to rest with its nose at the end of this block section.

FIG. 2 shows how the track circuit codes are updated as a train leaves the station. It also shows how the minimum headway is set according to how close the approaching train can approach the departing train without having to brake for restrictive track circuit codes.

In effect, a train under track circuit control is only "aware" of the position of the train ahead as the latter clears block section boundaries. The following train has no knowledge of the position of the train ahead within a block section. This is reflected in the stepped nature of the limit of movement authority which, as shown in FIG. 2, corresponds to the target point for the following train for normal service braking.

In terms of headway performance, track circuit arrangements suffer from the following disadvantages:

The position of a train is defined only by track circuit occupancy. For typical metro applications, this gives a minimum resolution no better than about 100 meters, depending on the number of track circuit codes available.

The minimum separation between trains is governed by the maximum permitted train speed and not by a train's actual speed. This means that slower moving trains take longer to clear block sections, thereby impeding the progress of a train behind. Furthermore, it means that the headway performance of lower performance rolling stock is constrained by the track circuit requirements for the highest performance rolling stock.

Certain objectives of a railway signalling system which the present invention aims to enable to be achieved are set out below:

(i) To permit trains to move through headway-critical zones of an urban passenger railway (metro) with safe distances of separation that are shorter than those achievable using conventional fixed block systems of protection. This increases the passenger-carrying capacity of the railway for the same inter-station journey times, dwell periods and rolling stock performance.

(ii) To permit an existing fixed block system, such as a fixed block track circuit system, to maintain safe distances of train separation over areas that are not headway-critical. This will usually be inter-station sections where, under normal headway conditions, train spacings are far greater than in headway-critical zones.

(iii) To permit the protection of train movements in headway-critical areas to revert to fixed block control, such as a fixed block track circuit control, when a moving block control system shuts down because of a failure.

(iv) To increase the flexibility of control over trains approaching stations; for example, to control the approach speed in order to minimize the headway at the expense of inter-station journey time.

(v) To permit energy-saving coasting control to be implemented without degrading the achievable headway. Such a facility would be particularly beneficial during an oil crisis, for example, when the metro authority may wish to implement peak-hour coasting over a long-term period, but not suffer loss of offered capacity.

U.S. Pat. No. 4,166,599 discloses a system in which, in a fixed block system, there is communication between vehicles via a communication channel so that a vehicle is informed of the next adjacent downstream occupied block section, but there is no back-up control if the communication channel breaks down.

EP-A-0 341 826 discloses a railway signalling system comprising both fixed and moving block control in which a transmit-only zone exists on the departure side of a platform and a receive-only zone exists on the approach side. The transmission is direct from the departing train to the one approaching. Also, the system described in EP-A-0 341 826 relies on the fixed block system to prevent a further train from entering the communication area when one is already receiving messages.

SUMMARY OF THE INVENTION

According to the present invention, there is provided a railway signalling system in which, to achieve inter-vehicle headway spacing for railway vehicles travelling on a track, there are a) control of vehicles by fixed block signalling and b) control of vehicles by moving block signalling via communication between vehicles, the moving block signalling occurring within a moving block control zone of the track and the fixed block signalling occurring outside that zone, there being the facility of two-way data transmission between vehicles throughout the moving block control zone.

This enables a reduction in permitted inter-vehicle spacing when compared with that permitted by a fixed block signalling system alone.

Preferably, the fixed block signalling system does not prevent a further vehicle from entering the moving block control zone when another vehicle is already in that zone and receiving a transmission via the moving block signalling system.

Preferably, the fixed block signalling also occurs within the moving block control zone if the moving block signalling fails.

BRIEF DESCRIPTION OF THE DRAWINGS

The present invention will now be described, by way of example, with reference to the figures of the accompanying drawings, in which.

DETAILED DESCRIPTION OF THE INVENTION

The example of the present invention to be described is a system in which a two-way data transmission system provides full moving block control only over the headway-critical areas of a railway. The system acts as an overlay on to an existing operational track circuit system and forms the primary signalling system over these areas. The track circuit system acts as a secondary back-up system.

The example concentrates on the application of such a system to a station area. Here, a departing train is "tracked" by a trackside moving block processor as it accelerates from the platform. The train's location is conveyed to an on-board processor of an approaching train which continually re-calculates the safe point at which it should commence braking in order to avoid a rear end collision, should the departing train stop suddenly.

Over areas of a track outside a moving block control zone, the normal distances separating trains are much greater. Here, the protection can be adequately achieved by track circuit control.

Within the moving block control zone, the track circuit protection system remains operational, but trains entering the zone transfer to moving block control. If the moving block control system shuts down because of a failure, then protection of train movements safely reverts to the track circuit system. Thus, the moving block system acts as a primary signalling system and the track circuit system provides a fall-back (secondary) mode of operation.

Under normal moving block control, the system would result in a significant improvement in headways permitted at stations, for the same inter-station journey times and dwell periods. Furthermore, the existence of a two-way track-train communication system would permit far more flexibility over the control of trains on the approach to stations. For example, the system has the potential of enabling selectable station-approach speeds, in order to optimize the headway by sacrificing a certain increase in inter-station journey time. Furthermore, energy-saving coasting control could be implemented without degrading the achievable headway. With fixed block control, this is generally not possible because of the increased time required to clear fixed-length block systems.

In contrast to what is described in EP-A-0 341 826, the communication system provides two-way data transmission throughout the moving block control zone; and there is no reliance on the fixed block system preventing a further train from entering the communication area when one is already receiving messages—it is assumed that the moving block processor manages two-way communication for the maximum number of trains that can theoretically exist within the control zone.

Figure 1:
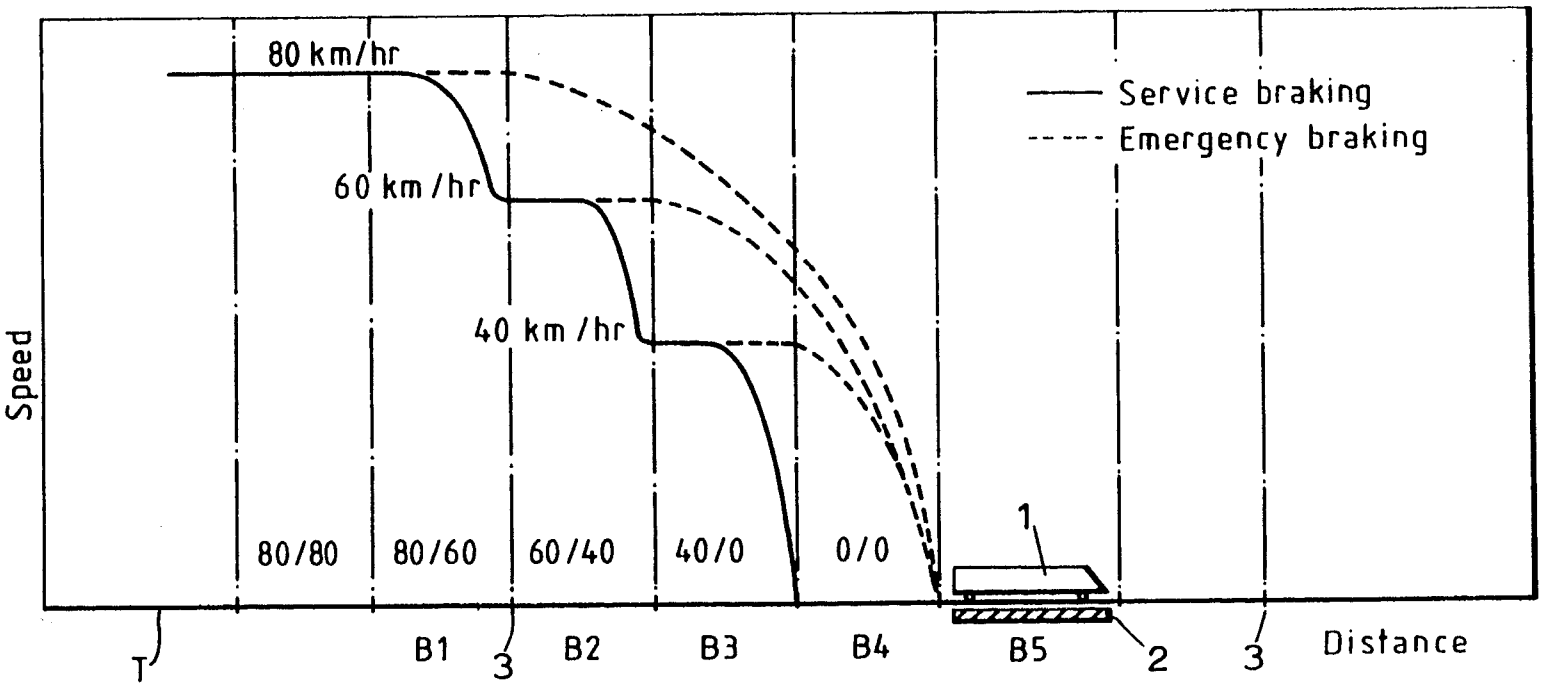
FIG. 1 PRIOR ART
FIG. 1 shows a plot of speed against distance in a typical track circuit-based system.
Figure 2:
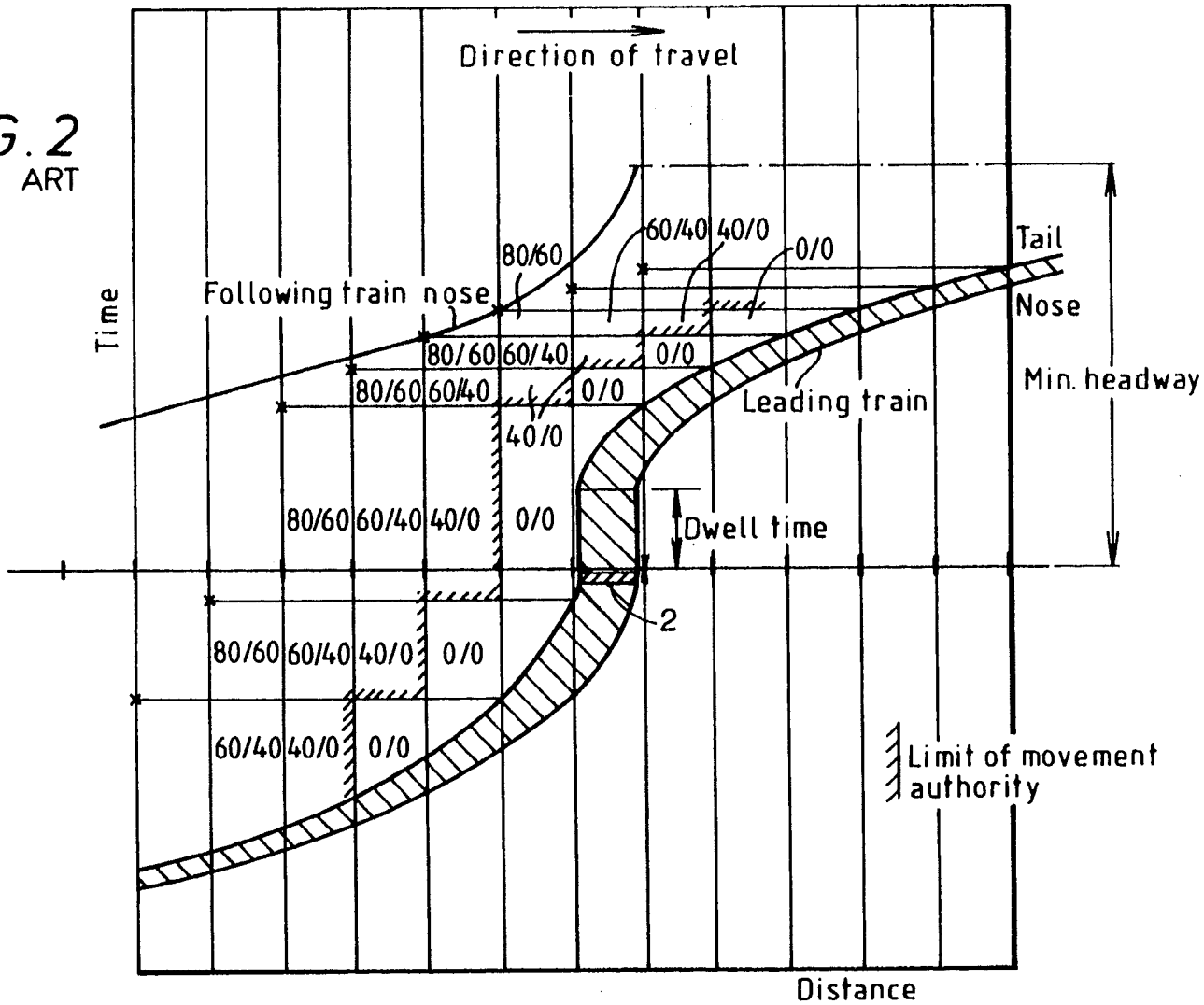
FIG. 2 PRIOR ART
FIG. 2 shows the track circuit codes as a train leaves a station.
Figure 3:
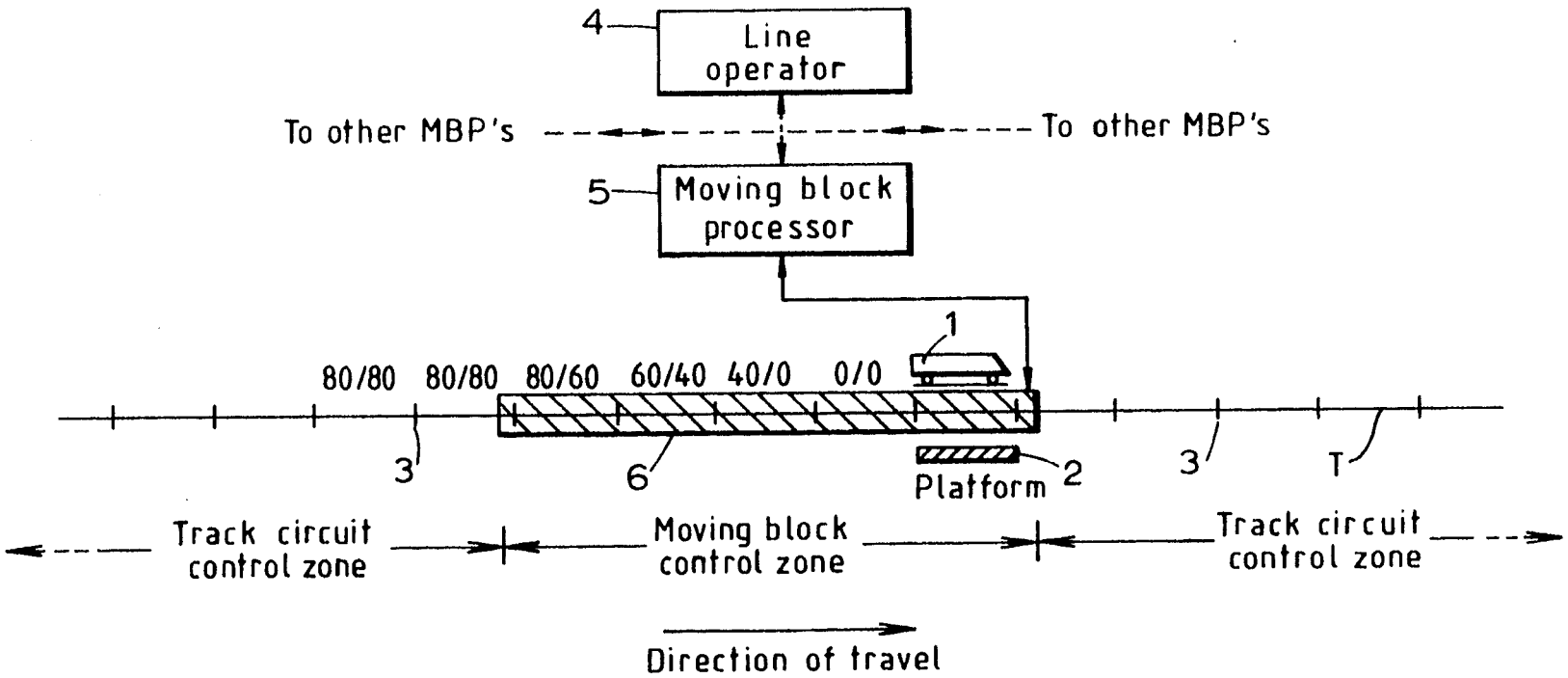
FIG. 3 is a general schematic diagram illustrating an example of the present invention.

Reference will now be made to FIG. 3, in which reference numeral 4 designates a line operator and reference numeral 5 designates a trackside moving block processor.

The trackside moving block processor 5 manages data transmission between successive trains in the moving block control zone of the track T. The communication sub-system is one which provides fast two-way data transmission between train antennae and trackside transmitting/receiving equipment as indicated generally by the cross-hatched area 6. This may be a "leaky feeder" radio system, an inductive cable system or some other means of communication.

A train entering the moving block control zone from a track circuit control zone switches from responding to track circuit codes to responding to moving block messages. This occurs just prior to the point where it would have to apply service braking because of the restrictive track circuit code ("80/60" in this example). The message transmitted by the moving block processor 5 consists of a continually updated limit of movement authority which corresponds to the last known position of the tail of the train ahead. From a current limit of movement authority, the train-borne processor of the following train computes the following:

The point at which it should commence a service brake application.

The point at which it should initiate an emergency brake application should the service brake fail to be applied. In addition, an emergency braking curve is generated which terminates at the limit of movement authority. Should the service brake fail to reduce the train speed adequately, the emergency braking system would be activated. The emergency braking curve is therefore inviolate and is the final means to avoid a rear-end collision.

Figure 4:
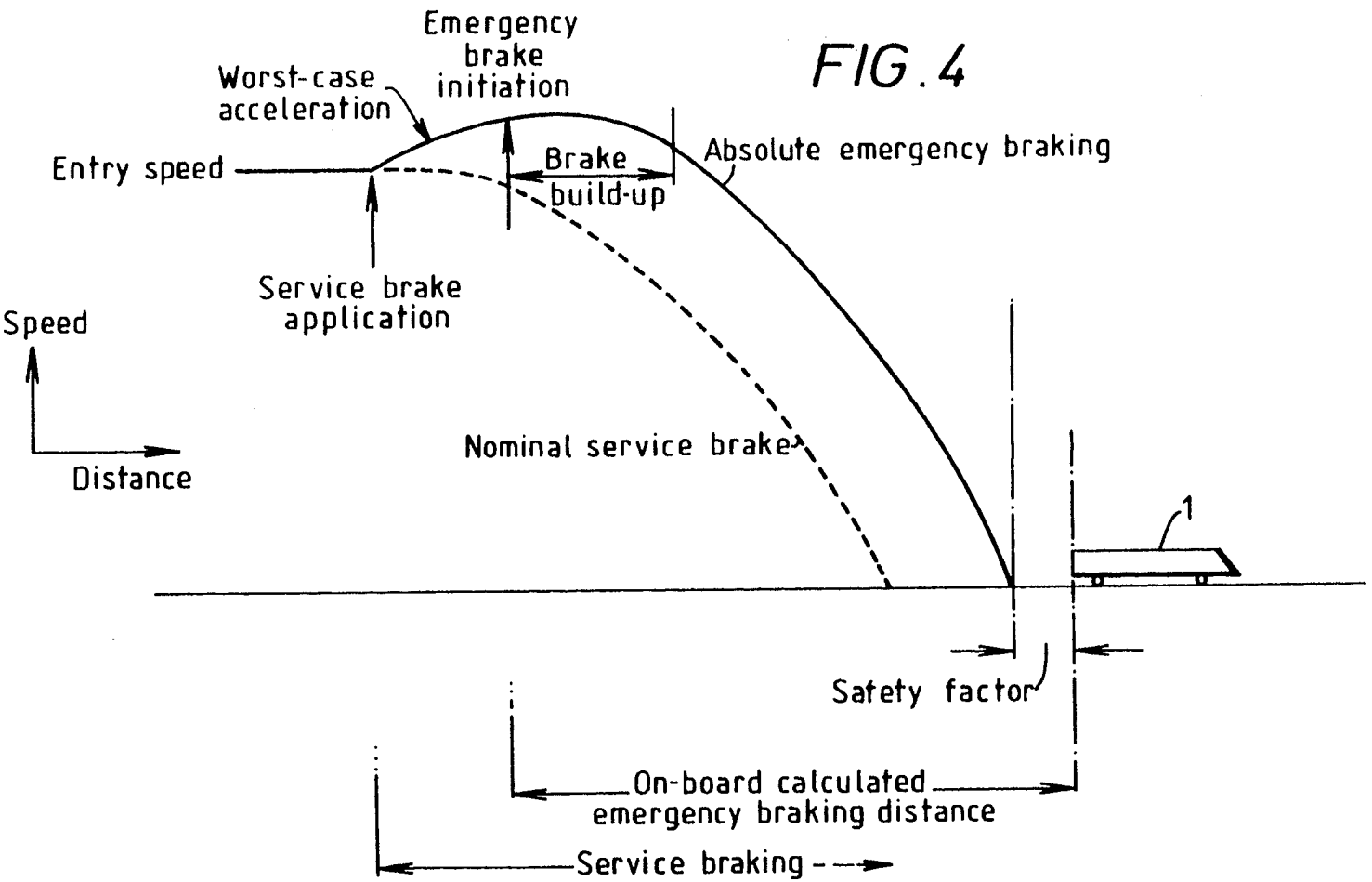
FIG. 4 shows typical braking curves for moving block control in the example.

The calculated points at which braking should commence depend on the train's speed, its braking capability and equipment response delays and tolerances. Typical braking curves are illustrated in FIG. 4.

Figure 5:
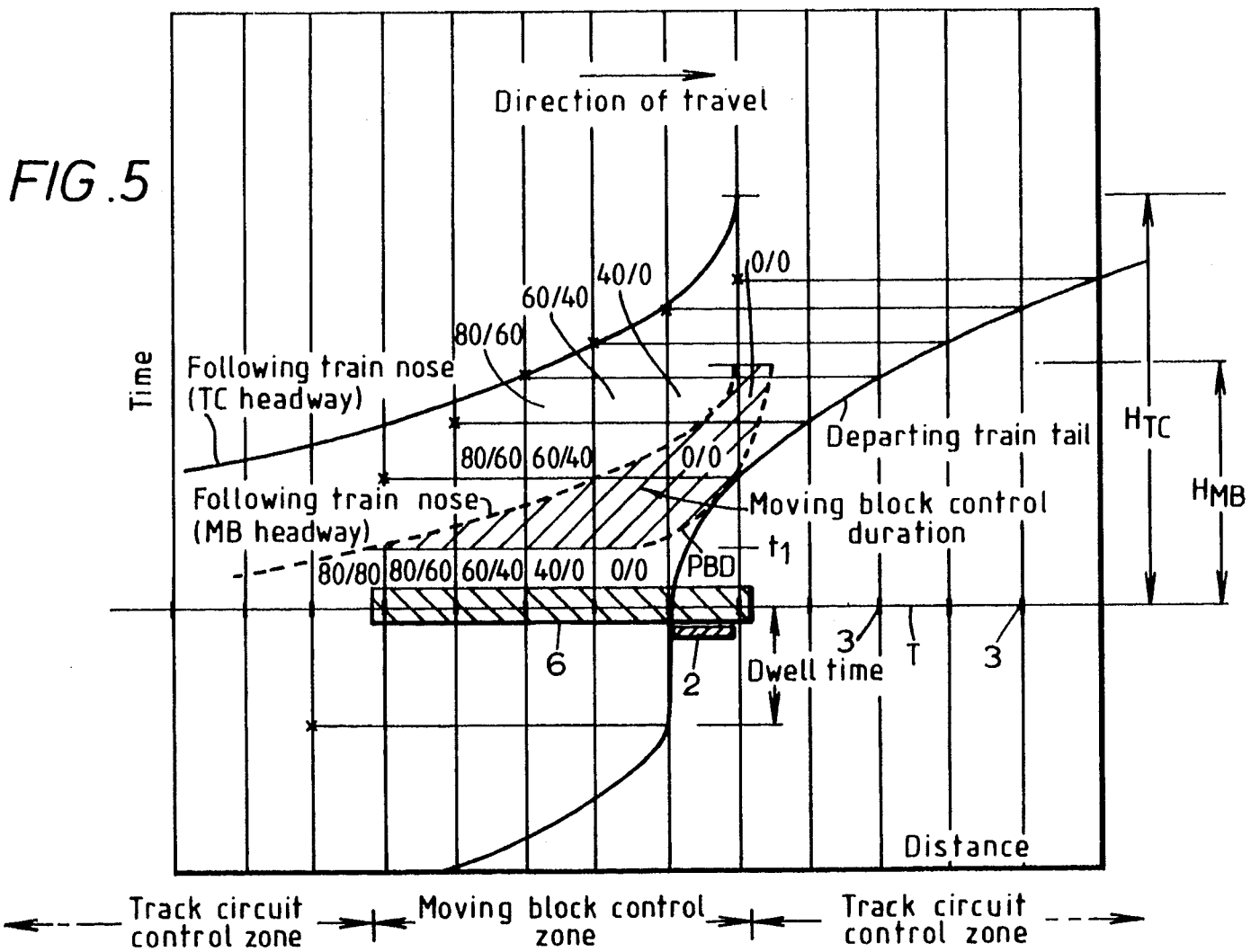
FIG. 5 shows curves illustrating headway improvement resulting from the example.

The improvement in headway resulting from the application of moving block (MB) control is illustrated in FIG. 5 and compared with that achieved with track circuit (TC) control. The minimum headway achievable by the track circuit control is $H_{TC}$, whilst that achievable from moving block control is given by $H_{MB}$. A train entering the moving block control zone would commence calculating its safe braking distance at time $t_1$, as shown. The braking distance would become progressively shorter as the train slowed for the station stop. This is indicated by the curve PBD which corresponds to the profile of braking distances represented in time. At minimum headway, this profile momentarily coincides with the time trajectory for the tail of the departing train. Thus a premature braking application is just avoided.

In terms of headway performance, the main benefits of the moving block control system described are as follows:

The position of a train within the moving block control zone is known with far greater accuracy than that achieved with track circuit control.

The separation between two trains within the moving block control zone depends on the actual speed of the following train rather than the maximum permitted speed.

The moving block system operates independently of the underlying secondary track circuit control system. A failure of the moving block system would result in a train reverting automatically to track circuit protection. This would allow a train service to be maintained albeit with a lower level of headway.

Other benefits are:

The existence of a quasi-continuous track-train data transmission system on the approach to a station permits useful control strategies to be implemented. For example, the station approach speed could be modified in order to permit maximum capacity to cope with short-term fluctuations in demand. The appropriate approach speed would be selected by the line controller or from an automated traffic regulation system as indicated in FIG. 3.

The moving block control system would permit energy-saving coasting to be introduced without any degradation to the minimum achievable headway.

What is claimed is:

1. A railway signalling system, comprising:

a) a track along which railway vehicles travel, the track having a moving block control zone; and b) means for achieving inter-vehicle headway spacing for vehicles travelling along the track, said means comprising:

i) fixed block signalling means, for controlling the inter-vehicle headway spacing of such vehicles on a fixed block basis;

ii) moving block signalling means, for controlling the inter-vehicle headway spacing of such vehicles when in the moving block control zone on a moving block basis via communication between the vehicles, there being the facility of two-way data transmission between the vehicles throughout the moving block control zone; and iii) the fixed block signalling means and the moving block signalling means being adapted so that vehicles are controlled by the fixed block signalling means when in the moving block control zone only if the moving block signalling means fails.

2. A system according to claim 1, wherein the fixed block signalling system does not prevent a further vehicle from entering the moving block control zone when another vehicle is already in that zone and receiving a transmission via the moving block signalling system.

3. A system according to claim 1, wherein the fixed block signalling means comprises a track circuit signalling system.

4. A system according to claim 1 wherein said moving block signalling means, includes moving block control means separate from the vehicles for arranging communication between them in the moving block control zone.

5. A system according to claim 4, wherein the moving block control means transmits to a vehicle in the moving block control zone an indication of the last known position of the tail of the vehicle ahead.

* * * * *

UNITED STATES PATENT AND TRADEMARK OFFICE

CERTIFICATE OF CORRECTION

PATENT NO. : 5,366,183

DATED : November 22, 1994

INVENTOR(S) : David C. Gill

It is certified that error appears in the above-identified patent and that said Letters Patent is hereby corrected as shown below:

On the cover page,
"ABSTRACT" line 12 change "mowing" to --moving--.

Signed and Sealed this

Twenty-eight Day of February, 1995

Bruce Lehman

*Attest:*

BRUCE LEHMAN

*Attesting Officer*

*Commissioner of Patents and Trademarks*